United States Patent [19]

Schweigharett et al.

[11] Patent Number: 4,518,479

[45] Date of Patent: May 21, 1985

[54] TIME PHASED ALTERNATE BLENDING OF FEED COALS FOR LIQUEFACTION

[75] Inventors: Frank Schweigharett, Allentown; David S. Hoover, New Tripoli; Diwaker Garg, Macungie, all of Pa.

[73] Assignee: International Coal Refining Company, Allentown, Pa.

[21] Appl. No.: 622,374

[22] Filed: Jun. 19, 1984

[51] Int. Cl.[3] ..... C10G 1/00

[52] U.S. Cl. ..... 208/8 LE

[58] Field of Search ..... 208/8 LE, 10

[56] References Cited

U.S. PATENT DOCUMENTS 4,222,848 9/1980 Carr et al. ..... 208/10

4,227,991 10/1980 Carr et al. ..... 208/10

FOREIGN PATENT DOCUMENTS 51204 5/1978 Japan ..... 208/8 LE

OTHER PUBLICATIONS

Ouchi et al., "Effect of Blending on Liquefaction of Coals", *Fuel*, vol. 63, pp. 78–83, Jan. 1984.

*Primary Examiner*—D. E. Gantz

*Assistant Examiner*—Lance Johnson

[57] ABSTRACT

The present invention is directed to a method for reducing process performance excursions during feed coal or process solvent changeover in a coal hydroliquefaction process by blending of feedstocks or solvents over time.

4 Claims, 2 Drawing Figures

TIME PHASED ALTERNATE BLENDING OF FEED COALS FOR LIQUEFACTION,

The government of the United States of America has rights in this invention pursuant to Contract No. DE-AC05-780R03054 (as modified), awarded by the U.S. Department of Energy.

BACKGROUND OF THE INVENTION

This invention pertains to a coal liquefaction process, enhanced with respect to reductions in process performance excursion during changeover in process feedstocks.

A well known process for the liquefaction of coals is the solvent-refining process whereby feed coal is slurried in a solvent, hydrogenated at elevated temperatures and pressures, and solvent de-ashed. Typical of such process is that described in U.S. Pat. No. 4,164,466 wherein the solvent de-ashing stage comprises a number of separation zones.

Also typical is the recycle of one or more streams from solvent de-ash separation zones to function as process solvent. Such a recycle is shown in U.S. Pat. Nos. 4,189,372, 4,119,523, and 4,230,556.

Other typical processes for the liquefaction of coal are the Kerr-McGee process (U.S. Pat. No. 3,607,718), Etchcol (U.S. Pat. Nos. 3,519,555; 3,540,995; 3,700,584; 4,045,329; 3,755,137; 3,856,658; 3,962,070; 4,054,504), Synthoyl (West German Pat. No. 2,700,309), Dow (U.S. Pat. Nos. 4,102,775; 4,136,013 and British Pat. No. 1,596,556), SRC-I (U.S. Pat. Nos. 3,884,794; 3,884,745; 3,884,796; 3,892,654; 4,110,192; 4,190,581), SRC-II (U.S. Pat. Nos. 3,884,796; 4,111,663; 4,312,763; 4,190,518), EDS (U.S. Pat. Nos. 3,726,784; 4,085,031; 4,085,032; 4,085,033; 4,283,267; 4,252,633; 4,125,452; 4,222,844), Chevron (U.S. Pat. Nos. 4,255,248; 4,264,429) and 2-stage liquefaction processes.

In the solvent refining process for coal liquefaction, an effective process solvent must be coal derived to permit continuous plant operation. The solvent must be a distillate with a nominal boiling range of 450°-900° F., must be able to sustain a 20-50 wt. % coal slurry through feed pumps, must rapidly accept coal dissolution products in solution or suspension, must act as a hydrogen donor/shuttling agent for hydrogen transfer under a free radical mechanism, and must carry the liquefaction product stream through solid/liquid separation processes and ultimately be recycled to continue the process.

The chemical properties of recycle solvents in the SRC process have been well documented. Such solvents exhibit a unique molecular composition comprising a highly complex mixture of polynuclear aromatic and hydroaromatic, polynuclear heteroaromatic and hydroaromatic, alkyl ($C_1$-$C_4$) substituted polynuclear aromatic and hydroaromatic, and alkyl ($C_1$-$C_4$) substituted polynuclear heteroaromatic and hydroaromatic compounds. The major molecular species (10-25%) are two ring aromatics or naphthalenes. In the SRC-I process, 0-30 wt. % new solvent material is generated on a MAF feed coal basis per pass of the solvent/coal mixture through the reactor.

It has been found that bituminous coal, when mixed with solvent, begins to dissolve at temperatures of 200°-250° F. The larger portion of the coal matrix, however, remains as a finely divided particulate at these conditions. Primary dissolution products are believed to be small molecules already present and trapped within the feed coal. Depending on coal type and rank, these compounds may represent 5-20% of the feed stock. In the Wilsonville SRC process, a coal feed slurry is held at 150°-250° F. before entering the preheater under a hydrogen partial pressure of approximately 2000 psi. This initial holding period allows the solvent to extract and exchange with the small trapped molecules in the coal and fill other voids created by loss of water and swelling.

Under preheater conditions (2000 PSI $H_2$ and up to 780° F.), nascent free radicals first radically combine with labile hydrogen from the feed coal to form a cresol soluble product. Hydrogenation reactions are exothermic and drive the preheater temperature upward by 25°-60° F. Under these conditions, the recycle solvent appears to rapidly solvate the primary liquefaction products. On entering the reactor, exothermic reactions drive the temperature to approximately 840° F. during a residence time of 30-60 minutes. Within the reactor and preheater, original recycle solvent and new coal product components act to shuttle hydrogen to free radical sites generated from splitting and cracking reactions.

Therefore, the solvent within the SRC process reactor will contain 0-30 wt. % MAF coal cracking and splitting products. This solvent may then be recycled to continue the process. Alternatively, this solvent may be hydrogenated before recycling or augmented with materials such as Light Solvent Refined Coal (LSRC) or makeup solvent.

The relationship between the characteristics of recycle solvents and process performance has been clearly demonstrated. Such factors as asphaltene and preasphaltene concentration, boiling point distribution, and degree of saturation all markedly effect process performance. Such parameters as conversion rate, oil make, hydrocarbon gas production, hydrogen consumption, and quality of recycle solvent are indicative of overall performance. A particulary important process performance parameter is the consumption of hydrogen within the liquefaction reactors of the SRC process. Excessive hydrogen consumption causes the hydroliquefaction process to become uneconomical and increases the formation of undesirable products.

It has been found that optimal hydrogen consumption can be achieved by optimizing the compatability of hydro-liquefaction process feed coal with process first stage recycle solvent. In the prior art, such compatibility is achieved through the maintenance of consistent feedstock characteristics and by recycle of process solvents produced in steady-state operation with a given feedstock. In a commercial hydro-liquefaction plant, however, such restrictions on feedstock are impractical and uneconomical. Feedstock changeover however, is unavoidable, notwithstanding its detrimental effect on hydrogen consumption and, therefore, on overall process economy.

It is therefore the general object of the present invention to provide a process by which feedstock changeovers may be accomplished without significantly degrading hydro-liquefaction process performance or economy.

BRIEF DESCRIPTION OF THE INVENTION

The present invention involves a solvent coal refining process in which degradation of process performance due to changes in feedstock characteristics is reduced or eliminated by feedstock blending and gradual controlled changeover in feedstock characteristics. Such a gradual controlled changeover from one feedstock to another promotes the maintenance of high levels of coal conversion, as well as reducing hydrogen consumption and hydrocarbon gas formation.

DETAILED DESCRIPTION OF THE INVENTION

Figure 1:
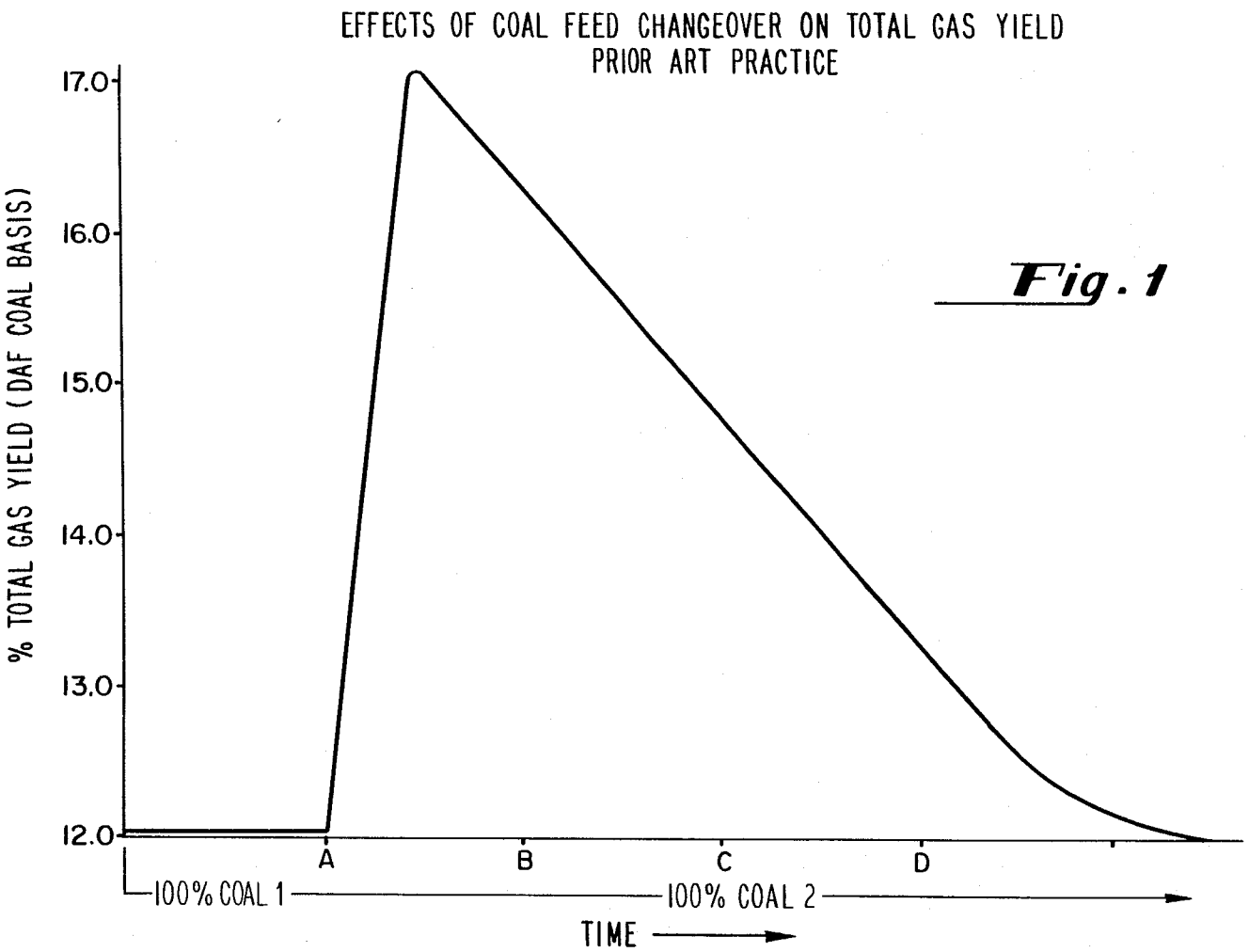
FIG. 1 is a graph showing the relationship between process gas yield and coal feed composition during an instantaneous changeover characteristic of the prior art.

A commercial coal liquefaction plant will process upwards of 30,000 tons of coal per day. Obviously, such large amounts of feed coal must be available from several different sources in order to insure continuity of supply to such a facility. Because of this multiplicity of suppliers, variations in characteristics of feed coals will necessarily differ from supplier to supplier and from time to time. It has been discovered that changes in the characteristics of feed coal are responsible for undesirable process performance excursions in a solvent-refining hydro-liquefaction facility. Specifically, changes in feed coal characteristics promote the production of undesirable hydrocarbon gases and increase the consumption of hydrogen in the process. Such performance excursions produce undesirable effects upon plant economies and may, in fact, entirely negate the economic advantages of a coal liquefaction facility.

It has been discovered that the major factor contributing to changeover performance excursions is the chemical mismatch between feedstock and process solvent which attends such a changeover. The process of the present invention minimizes this mismatch between solvent and feedstock by carefully introducing feedstocks of differing compositions over time.

At steady state operation, a solvent refining coal liquefaction plant employs recycle solvent which is strictly derived from the feed coal being processed. Such recycle solvent is intimately compatible with the feed coal from which it is derived and promotes overall process economies including optimal conversion of coal, minimal production of hydrocarbon gases, and minimal hydrogen consumption. In the prior art of coal liquefaction, changes in feedstock were accomplished essentially instantaneously and were always accompanied by significant degradations in process performance.

The alternative to prior feedstock changeover practices embodied in the present invention is a gradual controlled changeover from one feedstock to a second different feedstock by blending various amounts of the two coals. Such blending is also known in the petroleum refining art.

The blending of feedstocks is commonly practiced within the petroleum industry in order to control such material characteristics as viscosity or boiling point. However, this practice has not found application in the art of coal liquefaction as practiced during the last fifty years.

It must first be noted that there are fundamental differences between coal and petroleum feedstocks. Coal is composed predominantly of aromatic compounds and contains 5–20 wt. % inorganic material, while crude petroleum is predominantly aliphatic in nature and contains 0.001 to 0.1 wt. % inorganic matter. These material differences have in turn resulted in diverse developments in the art of hydroprocessing.

The mixing of petroleum feedstocks is practiced primarily for its effect of the characteristics of the feedstock. For example, feedstocks may be mixed in order to provide a stream of constant viscosity to the pumps feeding the cracking plant. Similarly, feedstocks may be mixed in order to facilitate optimal product mix in the first stage distillation vessel. However, in no case is the chemical composition of the feedstock a variable of primary importance to the efficiency of the refining process.

In contradistinction to the above-described practices within the petroleum industry, the history of coal hydroprocessing has shown that blending of coal feedstocks is not necessary for the liquefaction of coals. (Ouchi, et al., Fuel, Vol. 63, Page 78, January 1984) Despite such findings, it has been found by the applicants herein that the efficiency of the coal liquefaction process is dependent upon the compatibility between coal feedstocks and process solvent. Such process solvent is at once a product and a reactant within the system in that the solvent carries hydrogen from the gas phase to coal aromatic compounds not typically found in petroleum to generate hydroaromatic compounds which themselves donate hydrogen to coal-derived free-radicals. The degree of such hydrogen transport is directly related to the chemical composition of the solvent. Such interrelationships between process feedstock and solvent materials is unknown in the petroleum industry and is not, therefore, a factor in that industry's feedstock mixing practices.

The objective of the present invention, is therefore, to attain the highest possible level of compatibility between feed coal and process solvent. Such compatibility may be assessed by measuring the overall coal conversion, hydrogen consumption, and light gas production of the overall liquefaction process. Optimum feed-to-solvent compatability results in the highest possible conversion of coal and the lowest possible consumption of hydrogen and production of light hydrocarbon gases while deviations from this optimum compatability produce larger amounts of light hydrocarbon gases and consume correspondingly larger amounts of hydrogen per unit coal mass processed. Compatability may be expressed as the ratio between the percentage of hydrocarbon gas produced by an optimal coal/solvent match to the percentage gas produced by a coal/solvent system in which an old solvent and a new type of feed coal are processed together. (Alternatively, compatibility may be expressed as the ratio of hydrogen consumed by an optimal coal/solvent match to hydrogen consumed by a new coal/solvent pair.)

Typically, an optimal coal/solvent match produces about 7% light hydrocarbon gases, while a new coal/old solvent mix yields about 14%. The present invention mitigates the effect of feedstock changeover by introducing new feedstocks at an initial concentration adapted to maintain hydrocarbon gas production below a low and predetermined level. New feedstock concentration is subsequently increased over a period of time which depends on process space velocity, solvent inventory, and degree of difference between the two feed coals, until the feed stream reaches 100% concentration of the new feed coal. This time phase blending of feed coals allows the recycle solvent to gradually shift away from the first feed coal's characteristics toward the new feed coal's characteristics, thus reducing process excursions.

Referring now to FIG. 1, there is shown graphically the effect of coal feed changeover as practiced in the prior art upon one important process parameter—total gas yield. Inasmuch as the desired products of coal liquefaction processes are liquid hydrocarbons, light hydrocarbon gas production is undesirable and is indicative of degraded process performance.

The coal feed changeover of the prior art (at point "A" of FIG. 1) cause a typical process system to increase its gas yield from approximately 12% to 17%. Gas yield then falls until the feed coal and process solvent become compatible. In a commercial system, however, such compatibility may not be achieved prior to the succeeding feed change. The resulting plot of gas yield versus time would thus be a "saw tooth" shape.

Figure 2:
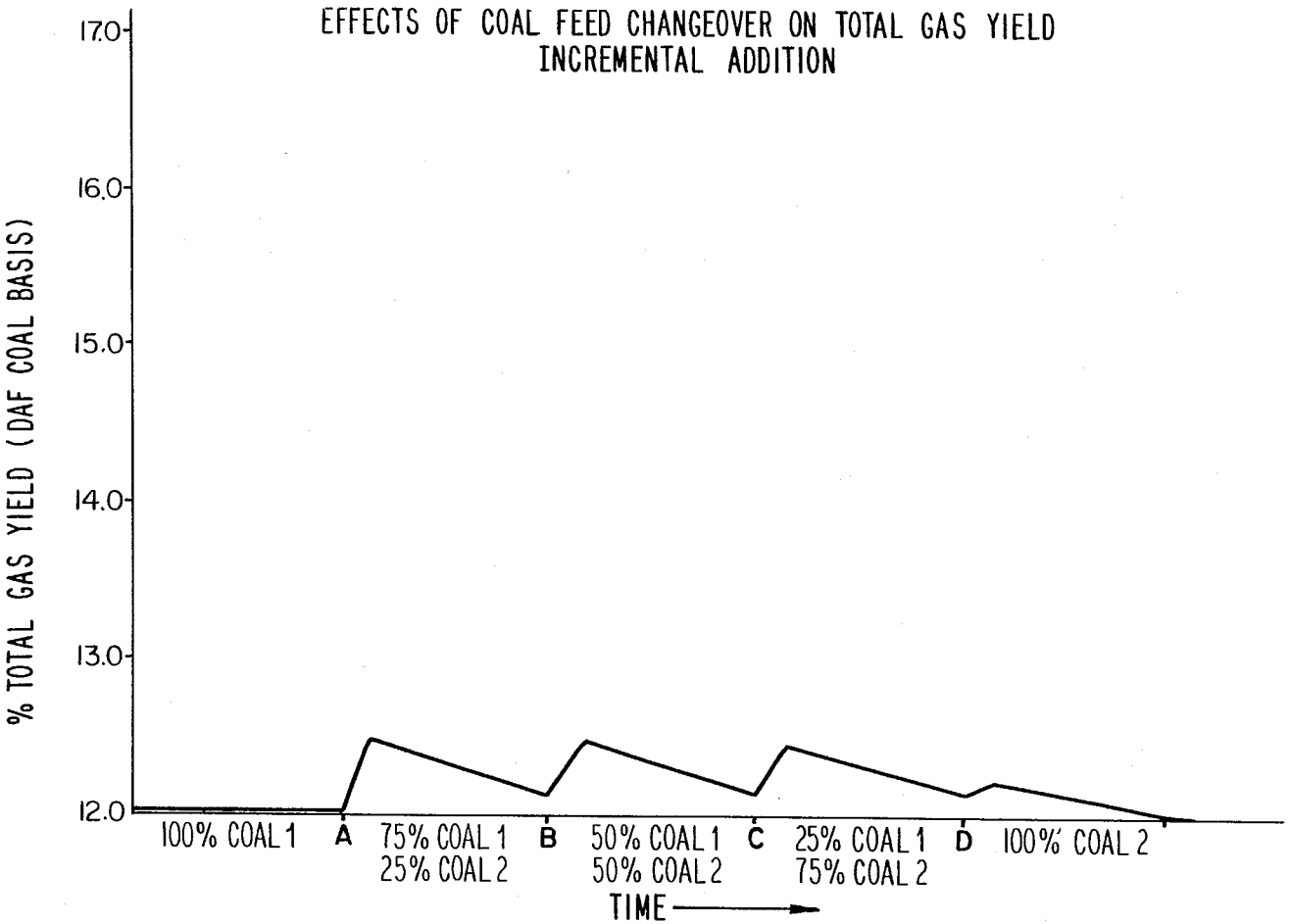
FIG. 2 is a graph showing the relationship between process gas yield and feed composition during an incremental changeover taught by the present invention.

Referring now to FIG. 2, there is shown graphically the effect of coal feed changeover according to the present invention upon total gas yield.

According to one protocol of the present invention, four stepwise incremental additions of a new coal (Coal 2) may be used during feed changeover. Such additions are carried out at points A,B,C,D of FIG. 2. Although each such addition increases total gas yield of the liquefaction process, that increase is of only 0.5% (as compared to 5% in the prior art.) This small increase is due to the maintenance of overall compatibility between the process solvent and feed coal streams.

For example, in a system having a 40% coal in slurry feed, operating at 840° F. and 2000 psig $H_2$ for 45 minutes (assuming 90% conversion), an increase in gas yield from 12% to 12.5% is expected. In addition, the time required for gas production to decrease to pre-changeover levels would be substantially less.

In some instances, it may be desired to introduce a new process solvent instead of, or in addition to a new coal. By analogy, introduction of process solvents foreign to the liquefaction system may be accomplished by sequential incremental additions so as to maintain solvent/coal compatibility.

Having thus described our invention in such detail as to allow one skilled in the art of coal hydroliquefaction to practice it, we claim as our invention:

1. A hydro-liquefaction process for coals wherein the feedstock changes from a first coal to a second coal through a sequence of time-phase blending in incremental additions of said second feed coal to said first feed coal and wherein process solvent derived from said first coal is incompatible with said second coal by causing an increase in the quantity of hydrocarbon gas make and hydrogen consumption during liquefaction, which process comprises: forming a slurry of finely divided feed coal and process-derived solvent, contacting said slurry with a hydrogen-rich gas, heating said slurry in the presence of said hydrogen-rich gas to react said heated slurry and to dissolve at least some of said coal, adding fresh hydrogen as required to form a liquefied coal slurry, passing said liquefied coal slurry to a separator to separate a vapor product stream and a condensed product stream, passing said condensed product stream to a distillation still and removing therefrom a residual bottoms product stream and a fraction recycled as process-derived solvent, wherein the time-phase blending change-over from said first coal to said second coal is effected by incremental sequential addition to said first coal of said second coal in an amount such that said process-derived solvent at the time of sequential addition is no less than 25% compatible with the feed coal admixture subsequent to said sequential addition of said coals to produce a decreasing level of light hydrocarbon gas production and hydrogen consumption compared with the last incremental admixture of said feed coals and after each of said incremental sequential additions operating said process for a sufficient length of time to permit said compatibility of solvent to coal to approach 100% before the next sequential incremental addition of said second feed coal composition to gradually shift away the characteristics of said process solvent derived from said first coal towards the characteristics of process solvent derived from said second coal.

2. The improved process of claim 1 wherein said second feed coal composition is sequentially added to said first feed coal composition in an amount such that said process-derived solvent at the time of said sequential addition is no less than 50% compatible with the feed coal mixture subsequent to said sequential addition.

3. The improved process of claim 1 wherein said second feed coal composition is sequentially added to said first feed coal composition in an amount such that said process-derived solvent at the time of said sequential addition is no less than 75% compatible with the feed coal mixture subsequent to said sequential addition.

4. The improved process of claim 1 wherein said second feed coal composition is sequentially added to said first feed coal composition in an amount such that said process-derived solvent at the time of said sequential addition is no less than 90% compatible with the feed coal mixture subsequent to said sequential addition.

* * * * *

UNITED STATES PATENT AND TRADEMARK OFFICE

CERTIFICATE OF CORRECTION

PATENT NO. : 4,518,479

DATED : May 21, 1985

INVENTOR(S) : SCHWEIGHARDT ET AL

It is certified that error appears in the above-identified patent and that said Letters Patent is hereby corrected as shown below:

On the title page;
The names of the inventors "FRANK SCHWEIGHARETT" and "DIWAKER GARG" which appear on the face of the patent should read ---FRANK SCHWEIGHARDT--- and ---DIWAKAR GARG---.

Signed and Sealed this

*Tenth* Day of *September 1985*

[SEAL]

*Attest:*

DONALD J. QUIGG

*Attesting Officer* *Acting Commissioner of Patents and Trademarks - Designate*